US008581520B1

(12) United States Patent
Wray

(10) Patent No.: US 8,581,520 B1
(45) Date of Patent: Nov. 12, 2013

(54) LIGHTING SYSTEM HAVING A DIMMING COLOR SIMULATING AN INCANDESCENT LIGHT

(75) Inventor: Donald L. Wray, Ocala, FL (US)

(73) Assignee: USAI, LLC, New Windsor, NY (US)

( * ) Notice: Subject to any disclaimer, the term of this patent is extended or adjusted under 35 U.S.C. 154(b) by 0 days.

(21) Appl. No.: 13/605,431

(22) Filed: Sep. 6, 2012

Related U.S. Application Data

(60) Provisional application No. 61/646,652, filed on May 14, 2012, provisional application No. 61/656,153, filed on Jun. 6, 2012.

(51) Int. Cl.
*H05B 37/02* (2006.01)

(52) U.S. Cl.
USPC ..... 315/307; 315/299; 315/312

(58) Field of Classification Search
USPC ..... 315/185 R, 186, 192, 291, 294, 297, 315/299, 300, 307, 312
See application file for complete search history.

(56) References Cited

U.S. PATENT DOCUMENTS

| | | | |
|---|---|---|---|
| 6,016,038 | A | 1/2000 | Mueller et al. |
| 6,094,014 | A | 7/2000 | Bucks et al. |
| 6,150,774 | A | 11/2000 | Mueller et al. |
| 6,166,496 | A | 12/2000 | Lys et al. |
| 6,211,626 | B1 | 4/2001 | Lys et al. |
| 6,234,648 | B1 | 5/2001 | Borner et al. |
| 6,292,901 | B1 | 9/2001 | Lys et al. |
| 6,340,868 | B1 | 1/2002 | Lys et al. |
| 6,459,919 | B1 | 10/2002 | Lys et al. |
| 6,528,954 | B1 | 3/2003 | Lys et al. |
| 6,548,967 | B1 | 4/2003 | Dowling et al. |
| 6,636,003 | B2 | 10/2003 | Rahm et al. |
| 6,692,136 | B2 | 2/2004 | Marshall et al. |
| 6,788,011 | B2 | 9/2004 | Mueller et al. |
| 6,806,659 | B1 | 10/2004 | Mueller et al. |
| 6,888,322 | B2 | 5/2005 | Dowling et al. |
| 6,897,624 | B2 | 5/2005 | Lys et al. |
| 6,965,205 | B2 | 11/2005 | Piepgras et al. |
| 6,967,448 | B2 | 11/2005 | Morgan et al. |
| 7,014,336 | B1 | 3/2006 | Ducharme et al. |
| 7,023,147 | B2 * | 4/2006 | Colby et al. ..... 315/291 |
| 7,038,399 | B2 | 5/2006 | Lys et al. |
| 7,064,498 | B2 | 6/2006 | Dowling et al. |
| 7,161,311 | B2 | 1/2007 | Mueller et al. |
| 7,161,313 | B2 | 1/2007 | Piepgras et al. |
| 7,180,252 | B2 | 2/2007 | Lys et al. |
| 7,256,554 | B2 | 8/2007 | Lys |
| 7,262,559 | B2 | 8/2007 | Tripathi et al. |

(Continued)

FOREIGN PATENT DOCUMENTS

| | | | |
|---|---|---|---|
| CA | 2302227 | A1 | 3/1999 |

*Primary Examiner* — Tung X Le
(74) *Attorney, Agent, or Firm* — St. Onge Steward Johnston & Reens LLC

(57) ABSTRACT

A lighting system has a lighting fixture with a white light source and a color light source, a control circuit pulses the white and color light sources and changes relative duty cycles of the light sources to alter a color output of the lighting fixture, in response to a change in a control signal from a controller. A comparator compares a reference voltage relating to an aggregate current driving the light sources to a signal voltage relating to the periodic signal from a signal generator. The comparator controls a switch that controls one of the light sources. A duty cycle of the color light source can be vary inversely to a duty cycle of the white light source.

31 Claims, 10 Drawing Sheets

(56) References Cited

U.S. PATENT DOCUMENTS

| | | | | |
|---|---|---|---|---|
| 7,274,160 | B2 | 9/2007 | Mueller et al. | |
| 7,288,902 | B1 | 10/2007 | Melanson | |
| 7,352,138 | B2 | 4/2008 | Lys et al. | |
| 7,387,405 | B2 | 6/2008 | Ducharme et al. | |
| 7,459,864 | B2 | 12/2008 | Lys | |
| 7,462,997 | B2 | 12/2008 | Mueller et al. | |
| 7,821,212 | B2 | 10/2010 | Wray | |
| 8,018,172 | B2 | 9/2011 | Leshniak | |
| 8,278,830 | B2 * | 10/2012 | Archibald et al. | 315/209 R |
| 8,360,603 | B2 * | 1/2013 | Rains | 362/231 |
| 2006/0028156 | A1 | 2/2006 | Jungwirth | |
| 2006/0109219 | A1 * | 5/2006 | Robinson et al. | 345/83 |
| 2008/0252197 | A1 * | 10/2008 | Li et al. | 313/502 |
| 2009/0224693 | A1 | 9/2009 | Mukai et al. | |
| 2010/0237803 | A1 | 9/2010 | Wolf et al. | |
| 2011/0031890 | A1 | 2/2011 | Stack | |
| 2011/0043134 | A1 | 2/2011 | Lee | |
| 2011/0109248 | A1 * | 5/2011 | Liu | 315/297 |
| 2011/0109249 | A1 * | 5/2011 | Liu et al. | 315/307 |
| 2011/0115407 | A1 | 5/2011 | Wibben et al. | |
| 2011/0164069 | A1 * | 7/2011 | Thompson et al. | 345/690 |
| 2011/0210678 | A1 | 9/2011 | Grajcar | |
| 2011/0248645 | A1 | 10/2011 | Custodis | |
| 2012/0249000 | A1 | 10/2012 | Kawai et al. | |
| 2013/0063042 | A1 | 3/2013 | Bora et al. | |

* cited by examiner

LIGHTING SYSTEM HAVING A DIMMING COLOR SIMULATING AN INCANDESCENT LIGHT

CROSS-REFERENCE TO RELATED APPLICATIONS

This application claims the benefit of U.S. Provisional Application Ser. No. 61/646,652 filed on May 14, 2012, entitled "LED Light Having a Dimming Color Simulating an Incandescent Light", and U.S. Provisional Application Ser. No. 61/656,153 filed on Jun. 6, 2012, entitled "Zero Percent Dimming LED Light Engine". The contents of both of those applications are incorporated herein by reference.

FIELD OF THE INVENTION

The apparatus described herein generally relates to the field of interior lighting; and, more directly, to the field of dimmable LED interior lighting.

BACKGROUND OF THE INVENTION

Light Emitting Diodes (LEDs) are desirable for use in lighting fixtures due to the efficiency and reliability of LEDs. LEDs used for interior lighting are typically high output devices that emit light that is a "pure" white (or nearly white) color. This color and output level work well for situations where bright lighting is desired. Some modern LED interior lights have a dimming feature for when lower light levels are desired. However, the color of an LED does not change appreciably when the LED is dimmed, as does an incandescent light.

Unlike LEDs, traditional incandescent bulbs change color as they dim. Normally, the filament in an incandescent bulb emits a light with a color temperature of about 3000 Kelvin (K) at full brightness, which is considered a "white" color. As the incandescent light is dimmed and the current is decreased, the filament emits a light that shifts away from "white" toward a more red/amber color output (e.g., a lower color temperature).

The color or appearance of a light source can be defined as a color temperature and is measured in degrees Kelvin (K). For example, a fluorescent light may have a very "cold" color temperature of 4000K (which may appear bluish), whereas a standard incandescent light bulb may have a "cool" color temperature of about 3000K (appears white) at full brightness. Further, a standard bulb may have a "warm" color temperature of 2000K (appears amber/red) when dimmed to 5-10% of full brightness. The color temperature change of an incandescent light bulb generally follows the color change of a cooling black body (i.e., the Black Body Locus). People sometimes prefer this "warming" effect and dislike the non-color shifting dimming of LED lights.

Therefore, what is desired is a lighting system suitable for LED lights which mimics the color curve of an incandescent light when dimming.

An object of the present invention is to provide an LED lighting fixture which mimics the warming color change of an incandescent bulb when the lighting fixture is dimmed.

Another object of the invention is to provide an LED lighting fixture with the above features and which provides a precise, "cool" light color that approaches a "white" light source when at full brightness.

Another object of the invention is to provide an LED lighting fixture having the above features and having the ability to dim in a smooth, gradual manner, without perceptible discrete steps or jumps in the level of light during dimming.

Another object of the invention is to provide an LED lighting fixture having the above features and having the ability to dim in a smooth, gradual manner, without perceptible, discrete steps or jumps in the color of light during dimming.

Another object of the invention is to provide an LED lighting fixture having the above features which is operable with standard drivers for LED lighting fixtures.

SUMMARY OF THE INVENTION

In an embodiment, the lighting system includes a lighting fixture having a white light source and a color light source, a controller generating a control signal corresponding to a selected brightness level of the lighting fixture, a control circuit controlling the white and color light sources in response to the control signal. The control circuit pulses the white light source and the color light source when the light fixture is within a range of brightness levels, and in response to a change in the control signal, the control circuit changes the relative duty cycles of the white and color light sources, to alter a color output of the lighting fixture, as the brightness level of the lighting fixture is changed by the controller.

In an embodiment, the lighting system also has a switch controlling the white light source or the color light source, a signal generator producing a periodic signal, a comparator receiving the periodic signal from the signal generator and controlling the switch. The comparator compares a reference voltage to a signal voltage, where the reference voltage relates (e.g., is proportional) to an aggregate (i.e., combined) current driving the white and color light sources, and the signal voltage relates to the periodic signal. The switch is in either an open or closed state when the reference voltage exceeds the signal voltage and is in the other state (i.e., closed or open) when the signal voltage exceeds the reference voltage.

The signal voltage varies between minimum and maximum values, and the maximum value exceeds the reference voltage when the brightness level of the lighting fixture is below a predetermined brightness level (where perceived color change begins to occur). When the brightness level of the lighting fixture is above the predetermined brightness level, the switch remains in the one of the open and closed states (where no perceived color change occurs). When the brightness level is below the predetermined brightness level, the switch alternates between the open and closed states (at least when the reference voltage exceeds the minimum value of the signal voltage).

The white light source and the color light source comprise LEDs and one of the light sources has a high total bias voltage and the other light source has a low total bias voltage (which is lower than the high total bias voltage of the one light source). The switch controls (for example, is in series with) the light source having the low total bias voltage, and the other light source having the high total bias voltage is connected in parallel with the switch and the light source having the low total bias voltage. When the switch is in the open state, the light source having the low total bias voltage is off, and the other light source having the high total bias voltage is on, and, when the switch is in the closed state, the light source having the low total bias voltage is turned on, and the other light source having the high total bias voltage is automatically turned off.

In an embodiment, the color light source has the low total bias voltage and is controlled with the switch. The switch is in the open state when the reference voltage exceeds the signal voltage, and is in the closed state when the signal voltage exceeds the reference voltage.

In an embodiment, a duty cycle of the color light source varies inversely to a duty cycle of the white light source. Optionally or additionally, the control circuit pulses the white light source and the color light source alternately, whereby when the white light source is pulsed on, the color light source is off and when the color light source is pulsed on, the white light source is off.

The lighting system further has a current source providing a current (such as a constant current driver) and the current produced by the current source drives both of the white and color light sources and the control circuit. The controller can comprise a dimmer connected to the current source.

A method of controlling a lighting system includes the steps of: providing a lighting fixture having a white light source and a color light source, generating a control signal corresponding to a selected brightness level of the lighting fixture, and pulsing the white light source and the color light source when the light fixture is within a range of brightness levels. In response to a change in the control signal, changing relative duty cycles of the white and color light sources, to alter a color output of the lighting fixture, as the brightness level of the lighting fixture is changed by the controller.

The method also includes providing a switch that controls one of the white light source and the color light source, generating a periodic signal, a comparator receiving the periodic signal and controlling the switch. The comparator compares a reference voltage to a signal voltage, where the reference voltage relates to (e.g., is proportional to) an aggregate (i.e., combined) current driving the white and color light sources, and the signal voltage relates to the periodic signal. The switch is in an open state or a closed state when the reference voltage exceeds the signal voltage and is in the other state (closed or open) when the signal voltage exceeds the reference voltage.

The signal voltage is varied between a maximum value and a minimum value, where the maximum value of the signal voltage exceeds the reference voltage (at least when the brightness level of the lighting fixture is below a predetermined brightness level). When the brightness level of the lighting fixture is above the predetermined brightness level, holding the switch in the one of the open and closed states, and when the brightness level is below the predetermined brightness level, alternating the switch between the open and closed states when the reference voltage exceeds the minimum value of the signal voltage.

The duty cycle of the color light source varies inversely to a duty cycle of the white light source, and the white light source and the color light source are alternately pulsed, whereby when the white light source is pulsed on, the color light source is off and when the color light source is pulsed on, the color light source is off.

A current is provided to drive the white and color light sources and the control circuit includes a dimmer which is connected to the current source.

DETAILED DESCRIPTION OF THE INVENTION

Disclosed herein is a lighting system which employs color light-emitting diodes (LEDs), along with white LEDs to mimic the color change of an incandescent bulb when dimming. This lighting system is primarily useful for LED lighting applications and is specifically designed to overcome the drawbacks of LED lighting for dimming lighting applications. In particular, the lighting system is suitable for dimmable lighting systems solely employing LED lights.

Figure 1:
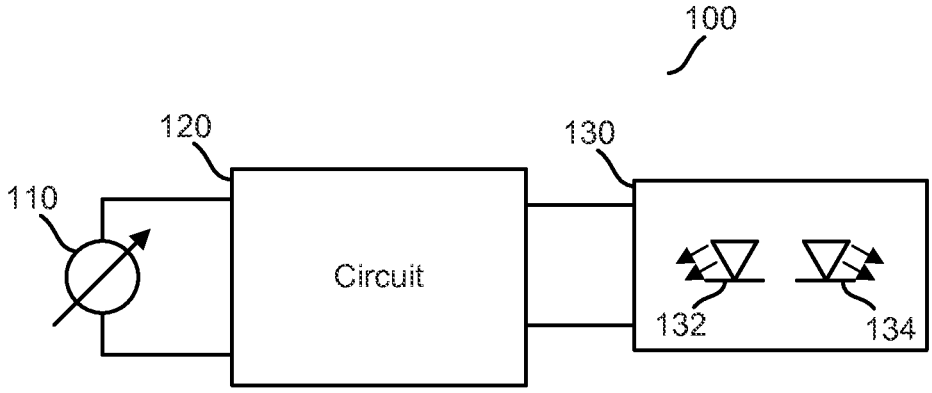
FIG. 1 is a block diagram of a lighting system according to one embodiment

As shown in FIG. 1, lighting system 100 includes dimmer 110, circuit 120, and light source 130. A user lowers the brightness level setting on dimmer 110, which is detected by circuit 120. Circuit 120, in response, lowers the light output of light source 130 while simultaneously changing its color. Preferably this color change increases the "warmth" of the light as light source 130 is dimmed, to mimic an incandescent bulb or black body light temperature curve. As a user raises the brightness setting on dimmer 110, circuit 120 increases the brightness of light source 130 and changes its color toward "white", as dimmer 110 approaches maximum brightness settings. At a maximum brightness setting, light source 130 preferably outputs a "white" light. The white light source may comprise an array of white LEDs that are precision "binned" (i.e., selected) so as to provide nearly pure white light when in the fully on position.

For purposes of this application, the term "white" light source refers to a light source which emits light having relatively equal amounts of color (e.g., sunlight being one example), such that the color of the light appears "white" to the human eye.

Lighting system 100 has a white light source 132 and a color light source 134 within light source 130. Preferably, the white light source includes LEDs producing light at or above 2800K and the color light source includes LEDs producing light at or below 2200K. When lighting system 100 is fully on (i.e., not dimmed), preferably only white light source 132 is on and color light source 134 is off. When lighting system 100 is dimmed to a predetermined brightness level, white light source 132 and color light source 134 are pulsed (e.g., white light source 132 is rapidly turned off for a brief time and color light source 134 is turned on for that time, and vice versa) so as to alter the aggregate (perceived) light emitted by the lighting system. The lighting system pulses the white and color light sources at a very high rate (e.g., at least 200-300 cycles per second (Hz)), which is imperceptible to the human eye. As lighting system 100 is dimmed further, the relative duty cycles of white light source 132 and color light source 134 are altered (i.e., color light source 134 is turn on for a larger and larger percentage of the time as compared to white light source 132) to increase the "warmth" of the perceived light.

Figure 2:
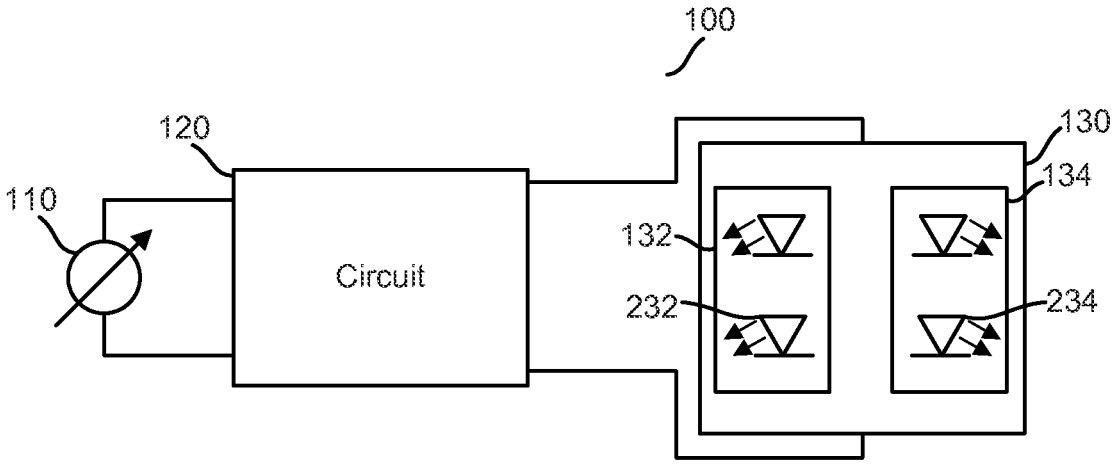
FIG. 2 is a block diagram of a lighting system according to the embodiment shown in FIG. 1.

FIG. 2 shows that light source 130 may comprise multiple arrays of LEDs. For example white light source 132 may be one array (e.g., series) of LEDs while color light source 134 is another array of LEDs in parallel with white light source 132. For example, white light source 132 could comprise an array of white LEDs 232, and color light source 134 could comprise an array of color LEDs 234.

Figure 3:
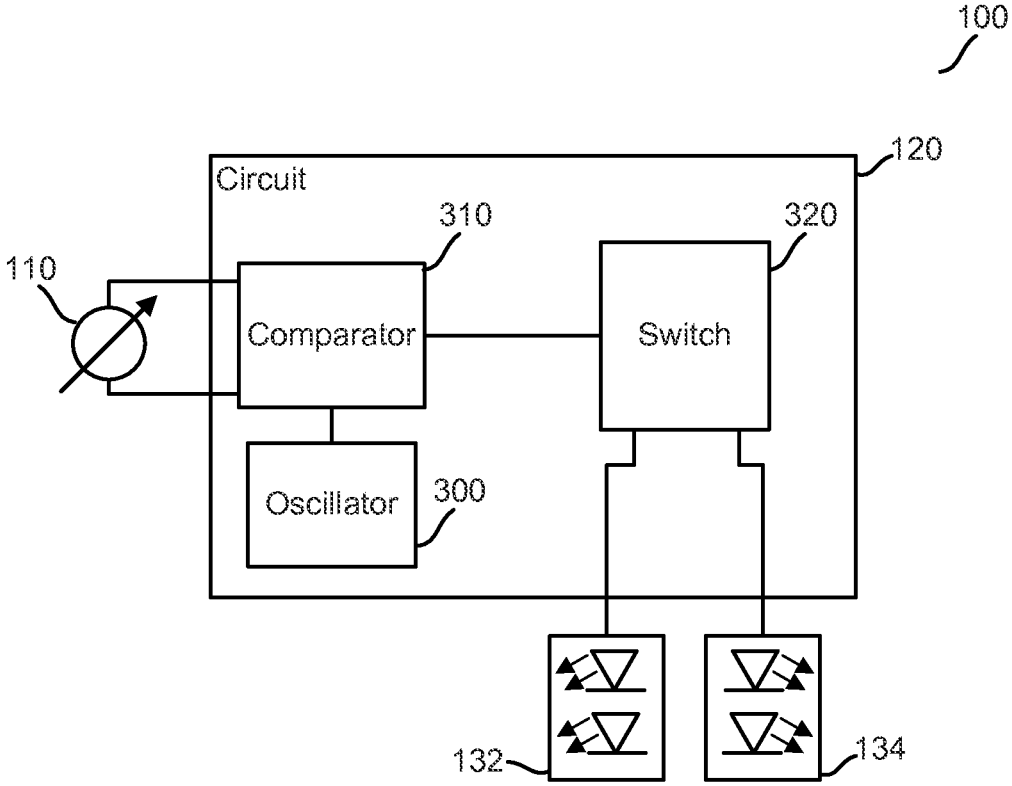
FIG. 3 is a block diagram of a lighting system according to the embodiment shown in FIG. 1.

FIG. 3 shows several components of one embodiment of circuit 120 in lighting system 100. Circuit 120 comprises comparator 310, oscillator 300, and switch 320. Oscillator 300 produces a periodic signal such as a sawtooth wave, such as a triangle-shaped wave. In one embodiment, oscillator 300 is a relaxation oscillator. Comparator 310 compares a reference voltage to the voltage of the periodic signal generated by oscillator 300. When the signal voltage exceeds the reference voltage, comparator 310 instructs switch 320 to turn on color light source 134 and shut off white light source 132.

The reference voltage will increase and decrease in proportion to the current supplied to lighting system 100. This will result in color light source 134 being on and white light source being off for a longer duty cycle of each period of the periodic signal as the current is decreased. The duration of the duty cycle of color light source 134 varies inversely to the current supplied to lighting system 100. In other words, the portion of the periodic signal during which color light source 134 is on increases as current is decreased because the reference voltage decreases proportional to the current.

Turning on color light source 134 automatically switches off white light source 132. Therefore, white light source 132 will be on for a portion of the periodic signal that is below the reference voltage. This portion of the periodic signal during which white light source 132 is on decreases as current is decreased because the reference voltage is proportional to the current. The current supplied to lighting system 100 is generally controlled by a user input via dimmer 110. Thus, as dimmer 110 is operated to dim the lights, more color light is emitted by lighting system 100 in proportion to the white light emitted.

Figure 4:
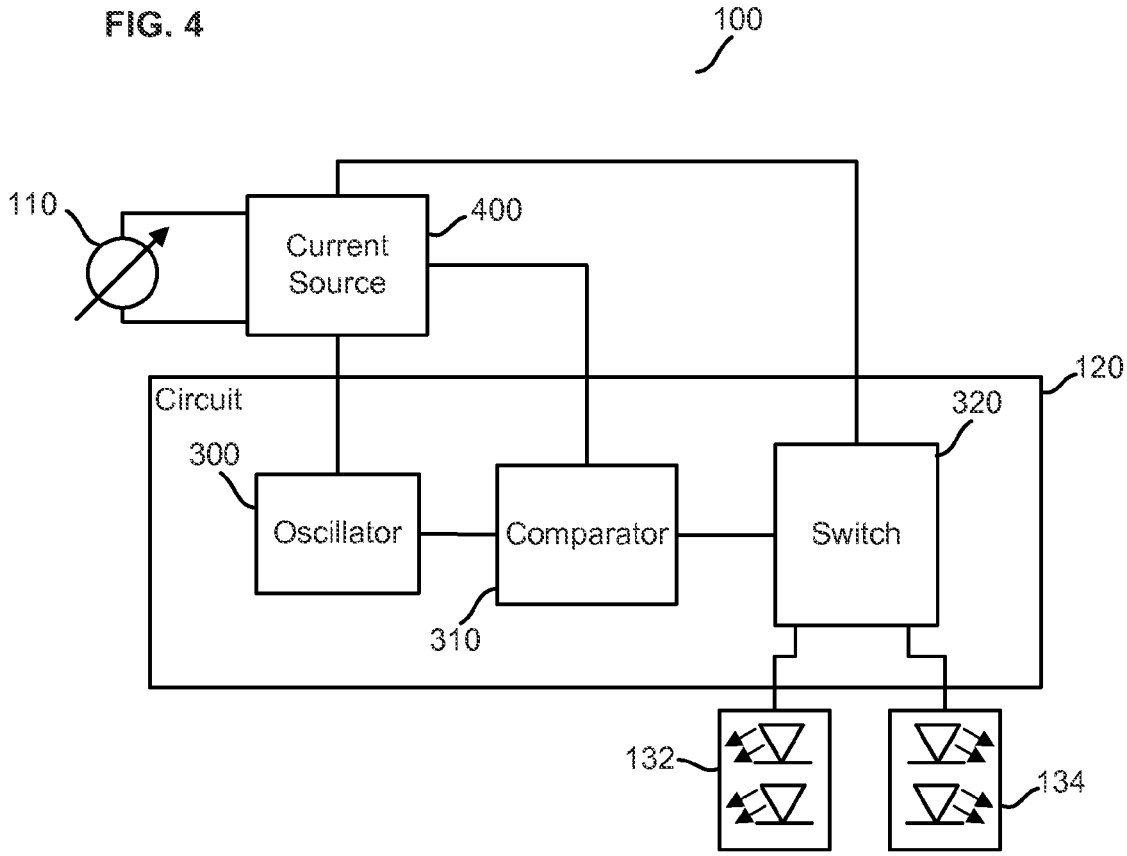
FIG. 4 is a block diagram of a lighting system according to the embodiment shown in FIG. 1.

FIG. 4 shows a more detailed diagram of an embodiment of lighting system 100. Lighting system 100 now includes current source 400, which is controlled by dimmer 110. Current source 400 is a constant current supply wherein the current level can be varied by dimmer 110, but the current will be constant at a given setting regardless of the load applied. The reference voltage used by comparator 310 is determined by the current source 400 output to lighting system 100. Current source 400 also supplies power to oscillator 300. Switch 320 diverts current from current source 400 to selectively and/or alternately power white light source 132 and color light source 134.

Figure 5:
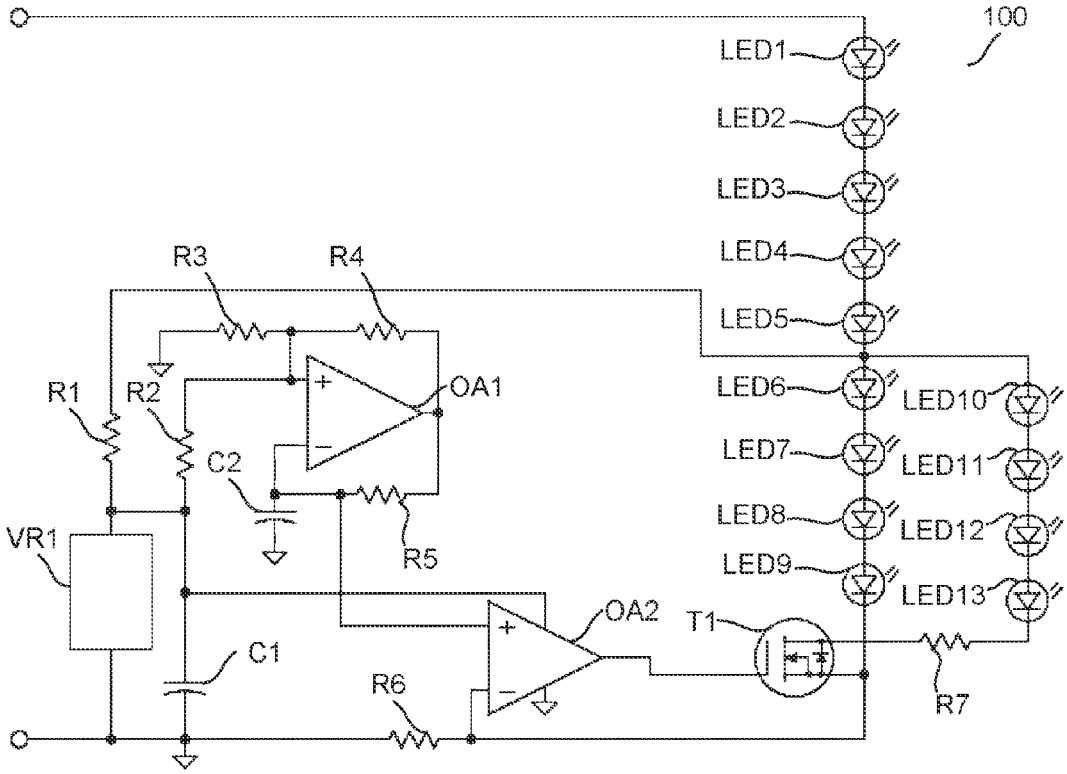
FIG. 5 is a schematic of a lighting system according to the embodiment shown in FIG. 1.

FIG. 5 shows a schematic of one embodiment of lighting system 100. The following table provides the component values for the embodiment shown in FIG. 5.

TABLE 1

Component values for circuit shown in FIG. 5.

| LABEL | COMPONENT |
|---|---|
| VR1 | ZRC500 |
| R1 | 4.75K |
| R2 | 221K |
| R3 | 15K |
| R4 | 100K |
| R5 | 100K |
| R6 | 1.0 |
| R7 | 1.0 |
| OA1 | LMV342 |
| OA2 | LMV342 |
| C1 | 1 uF |

TABLE 1-continued

Component values for circuit shown in FIG. 5.

| LABEL | COMPONENT |
|---|---|
| C2 | 0.1 uF |
| LED1-LED9 | White LED |
| LED10 | Amber LED |
| LED11 | Amber LED |
| LED12 | Red LED |
| LED13 | Deep Red LED |
| T1 | FET |

In FIG. 5, OA1 is an op amp for oscillator 300, which in this embodiment is a relaxation oscillator. The relaxation oscillator produces a saw-tooth wave, for example at 200-300 Hz. A second op-amp circuit (including op-amp OA2) below the relaxation oscillator operates as a non-inverting amplifier (i.e. comparator 310) that switches the transistor T1 (acting as switch 320) operating LED10-LED13 "on" when the voltage of the saw-tooth signal is higher than a reference voltage at current sense resistor R6. As the LED brightness and current is decreased, the reference voltage for the non-inverting amplifier OA2 decreases. At a predetermined point, the reference voltage drops below the voltage of the saw-tooth signal produced by the relaxation oscillator OA1, thereby activating LED10-LED13. Activating LED10-LED13 will deactivate LED6-LED9, because the aggregate forward voltage drop for LED10-LED13 is lower than that of LED6-LED9, thereby diverting all of the current to LED10-LED13. The result is that as the light fixture is dimmed and less current is run through lighting system 100, LED10-LED13 will spend more of the period of the saw-tooth wave on and LED6-LED9 will spend more of the period of the wave off. Preferably LED10-LED13 will be color light source 134 and LED6-LED9 will be white light source 132. LED1-LED5 are an auxiliary white light source that remains on at all times.

As shown in FIG. 5 the LED's are connected to the main fixture constant current source driver (e.g., 700 ma) at the circles at the far left side of lighting system 100. When the dimmer is in the full bright position, all of the current goes through the first and second sets of white LED's (LED1-LED5 and LED6-LED9). This allows precision binned white LED's to be used such that lighting system 100 can provide a high quality white light when in the fully on state. Preferably, there is no perceived color change when the lighting system is in the full bright state.

The current sense resistor R6 is in series with both the white LED's and the color LED's (LED10-LED13) so that, when the lighting system 100 is dimmed, the current sense resistor R6 provides a voltage proportional to the LED's aggregate (i.e., combined) current flow on the comparator op-amp OA2, which compares the relaxation oscillator op-amp OA1's output (i.e., the signal voltage) to the reference voltage. When the main LED driver is fully on (700 ma in this example) the reference voltage will be 0.70 volts on the comparator and the maximum signal level of the relaxation oscillator is designed to be below that value thus keeping the output of the comparator a logic 0, off state for field-effect transistor (FET) T1 which will not allow any current to flow thru the color mixing LED10-LED13.

Relaxation oscillator op-amp OA1 and comparator op-amp OA2 may be part of the same package, i.e. an LMV342. The relaxation oscillator is adjustable by changing component values to set the low voltage, the high voltage, and the period of an almost saw tooth waveform output. The relaxation oscillator is set so the peak high (i.e., maximum signal voltage) is lower than the reference voltage when the dimmer is fully on. For example the minimum and maximum signal voltages can be approximately 0.01V and 0.650V, respectively.

Color light source 134 (LED10-LED13 in this embodiment) will start to come on when the main dimmer provides less than a predetermined current (e.g., less than 650 mA) to the LEDs and at that point the ratio of current going through the second set of white LEDs (LED6-LED9) and the color changing LED's (LED10-LED13) changes by the ratio that the saw tooth wave is "sliced" by comparator 310 (OA2). Thus the LED array circuit pulses the second set of white LEDs and the color LEDs on and off. As lighting system 100 is dimmed further (and the aggregate current through the LEDs is thereby reduced), the red/amber branch (color light source 134) emits light a greater percentage of the time and the second set of white LEDs (white light source 132) in the white branch emits light a lesser percentage of the time. This occurs as more and more of the oscillator curve is spent driving the red/amber branch.

The aggregate forward voltage drop of the red/amber color LEDs (LED10-LED13) is lower than the aggregate forward voltage drop of the parallel set of white LED's (i.e., the second set of white LEDs LED6-LED9), so that, when field-effect transistor (FET) T1 switches the red/amber color LED branch on, all of the current will be redirected to the red/amber color LEDs (LED10-LED13), thereby robbing the current from the second set of white LED's (LED6-LED9). This allows the perceived color change to occur only when dimming takes place and, by changing the ratio of the duty cycles of the red/amber LEDs and the white LEDs, the aggregate (perceived) color produced by the lighting system can be made to approximate the color change curve of an incandescent light bulb during dimming, along the Black Body Locus.

Preferably, the amber LEDs in the color LEDs include or consist of phosphor converted amber LEDs, such as the Philips LXM2-PL01 series, which use an Indium Gallium Nitride (InGaN) die internally and internal phosphor generates amber light. It has been found that phosphor converted amber LEDs produce a relatively broad light spectrum, as compared to the monochromatic AlInGap-type amber LEDs, which produce light in a relatively narrow spectrum. The relatively broad light spectrum produced by the InGaN-type LEDs provides a warmer lighting effect during dimming. In addition, the color produced by InGaN-type amber LEDs is more stable over different operating temperature ranges, as compared to AlInGap-type amber LEDs, which provides for more predictable and controllable mixing of colors during dimming.

Figure 6:
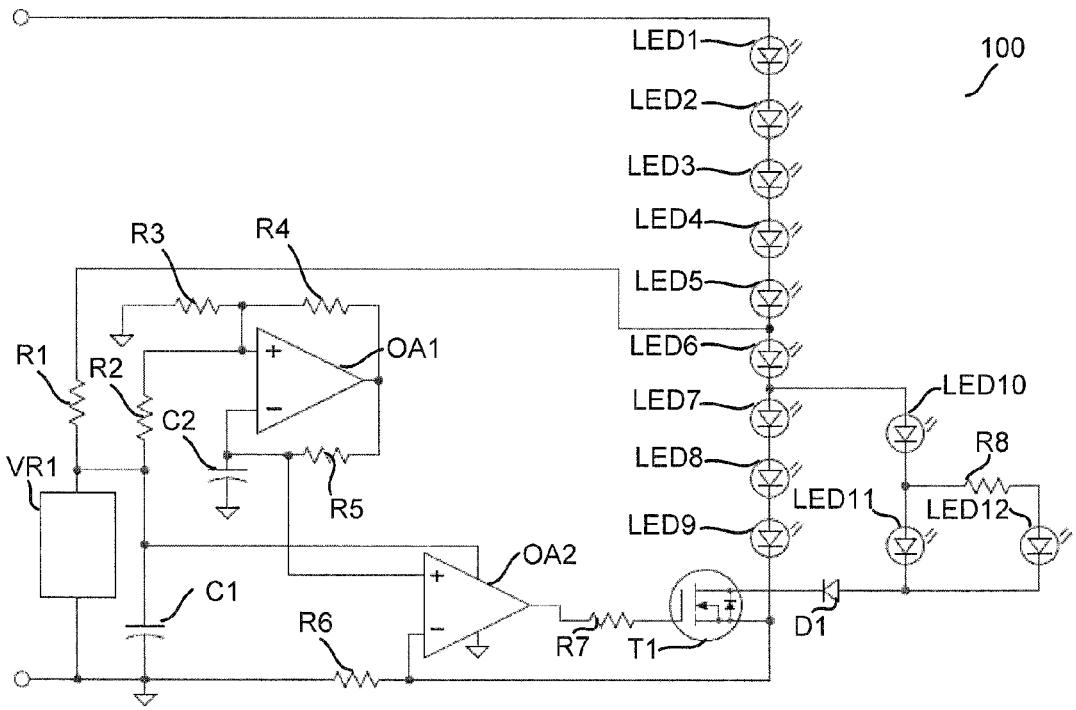
FIG. 6 is a schematic of a lighting system according to the embodiment shown in FIG. 1.

Referring to FIG. 6, the LED array circuit can have a red/amber color LED branch having a red LED12 and a resistor R8 in parallel with an amber LED11, which are in series with a second amber LED10 and a diode D1. This combination has the unique function that when the current is reduced in the amber/red branch of LED's (LED10-LED12) the red LED12 will get brighter relative to amber LED 11 thus providing more red color from the color LED branch at the lower dim levels. The following table provides the component values for the embodiment shown in FIG. 6.

TABLE 2

Component values for circuit shown in FIG. 6.

| LABEL | COMPONENT |
|---|---|
| VR1 | ZRC500 |
| R1 | 4.75K |
| R2 | 221K |

TABLE 2-continued

Component values for circuit shown in FIG. 6.

| LABEL | COMPONENT |
|---|---|
| R3 | 10K |
| R4 | 100K |
| R5 | 100K |
| R6 | 1.0 |
| R7 | 20 |
| R8 | 49.9 |
| OA1 | LMV342 |
| OA2 | LMV342 |
| C1 | 1 uF |
| C2 | 0.01 uF |
| LED1-LED9 | White LED |
| LED10 | Amber LED |
| LED11 | Amber LED |
| LED12 | Red LED |
| T1 | FET |

The LED circuit array of FIG. 6 provides a LED light having essentially three states. In a first state, dimmer 110 is in the fully on position (no dimming). In this state, only white LED1-LED9 are powered. When the light is dimmed to a predetermined brightness level, the light fixture enters a second state, where red/amber color LED10-LED12 are cycled on to provide a perceived warmer color during dimming. From the second state, the light fixture transitions into a third state, where the red LED12 gets brighter than the parallel amber LED11 as current is reduced to a low level, to provide more red color at the lower dim levels.

In the circuit of FIG. 6, the values of resistor R8 and the relaxation oscillator can be selected so that the color change during dimming very accurately resembles the look of an incandescent light bulb when dimming. Capacitor C2 of the relaxation oscillator can be 0.01 uF so that the oscillator produces a signal with a high frequency (e.g., above 200 Hz) to avoid any perceptible flicker. Also, resistor R3 can be 10K, to set the threshold at which color mixing begins to occur to a relatively high level so that color mixing starts as soon as dimming occurs.

A change to the FIG. 6 circuit is the placement of the red/amber branch after LED6 instead of LED5. This increases the amount of white light emitted when the red/amber LED10-LED12 are on during the dimming phases. In particular, the first set of white LEDs comprises LED1-LED6, and the second set of white LEDs comprises LED7-LED9.

Figure 7:
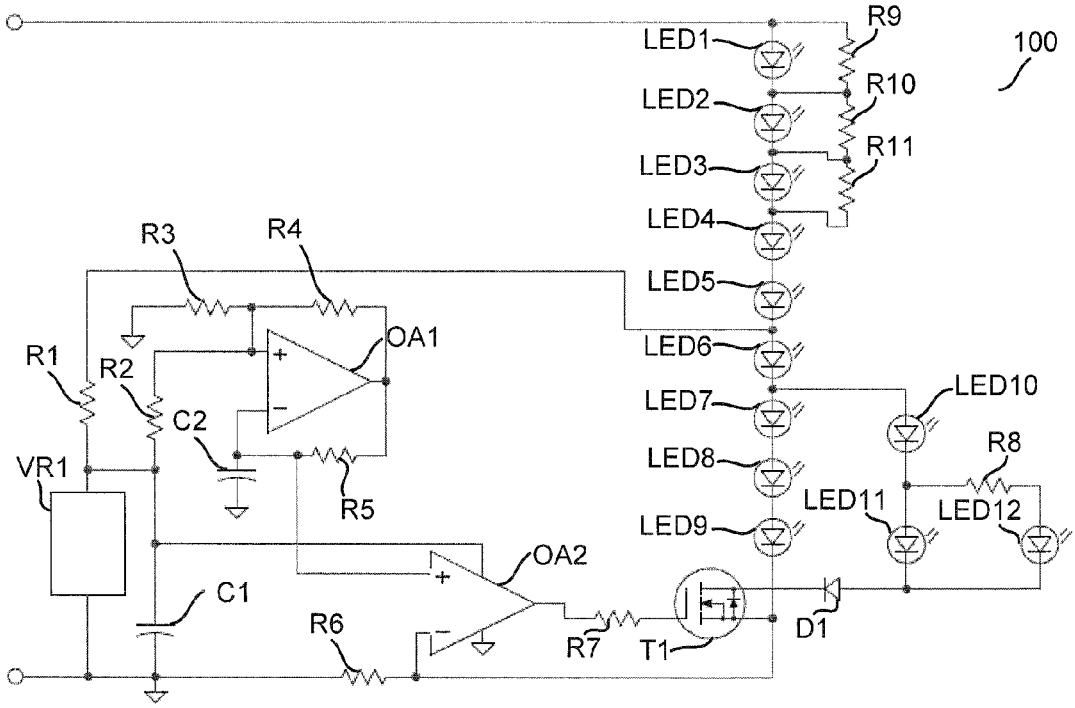
FIG. 7 is a schematic of a lighting system according to the embodiment shown in FIG. 1.

FIG. 7 shows a circuit which includes four states—the three states featured in the FIG. 6 circuit and a fourth state at very low dim (almost off). In this circuit, resistors R9-R11 are added in parallel to white LEDs LED1-LED3, respectively. As the current begins to approach the 5-10 mA range (at very low brightness settings), R9-R11 draw current away from LED1-LED3, resulting in a final dimmed state with the reddest (or warmest) color output. This would typically occur when the fixture is producing almost no useable light, but produces perceptible light and color when viewed directly or in a darkened room (for example, extremely dim lighting in a movie theater). The following table provides the component values for the embodiment shown in FIG. 7.

TABLE 3

Component values for circuit shown in FIG. 7.

| LABEL | COMPONENT |
|---|---|
| VR1 | ZRC500 |
| R1 | 4.75K |
| R2 | 221K |
| R3 | 10K |
| R4 | 100K |
| R5 | 100K |
| R6 | 1.0 |
| R7 | 20 |
| R8 | 49.9 |
| R9-R11 | 200 |
| OA1 | LMV342 |
| OA2 | LMV342 |
| C1 | 1 uF |
| C2 | 0.01 uF |
| LED1-LED9 | White LED |
| LED10 | Amber LED |
| LED11 | Amber LED |
| LED12 | Red LED |
| T1 | FET |

Figure 8:
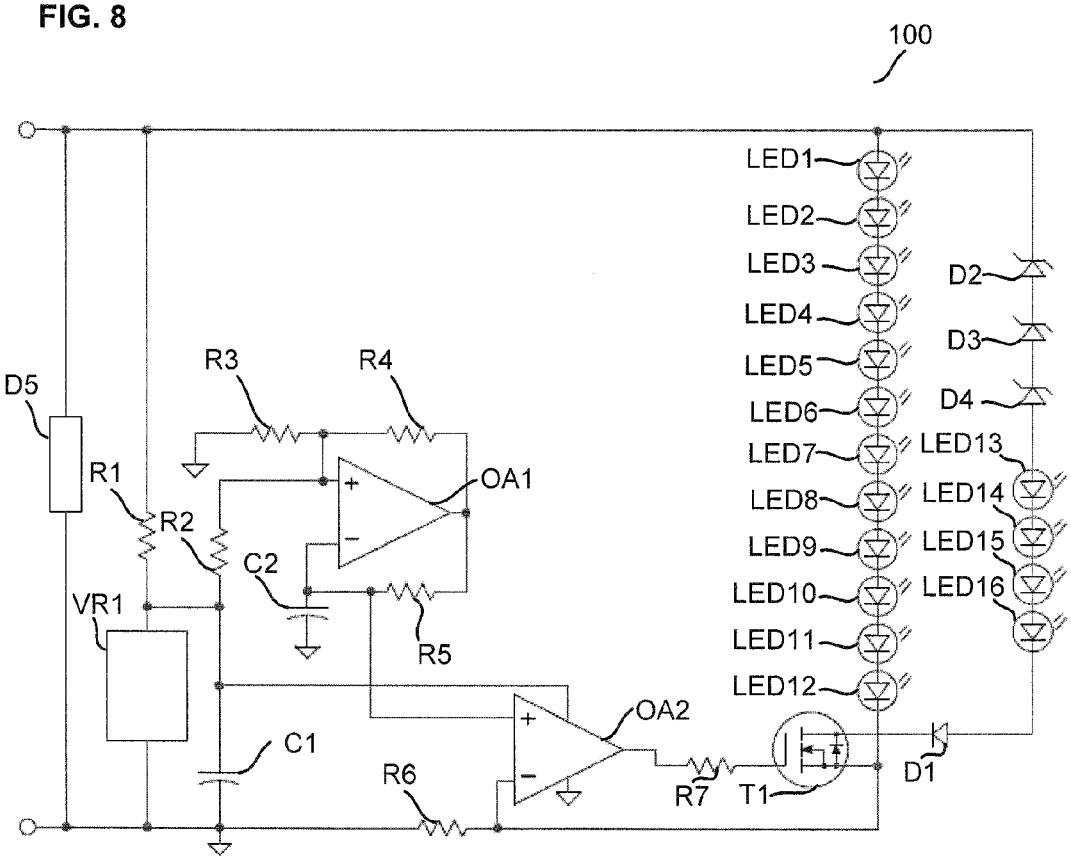
FIG. 8 is a schematic of a lighting system according to the embodiment shown in FIG. 1.

FIG. 8 shows another schematic of an embodiment of the lighting system 100. In this embodiment white light source 132 comprises LED1-LED12. Color light source comprises string of LED13-LED16, a diode D1, and three Zener diodes D2-D4. D1 prevents current from leaking from OA2 to the color LED circuit via transistor T1. In this embodiment, Zener diodes D2-D4 increase the total bias voltage of color light source 134 to approximate that of white light source 132. This ensures that brightness and current levels of the two light sources are closely matched. However, color light source 134 has a total bias voltage that is lower than that of white light source 132, so that when color light source 134 switches on, it automatically diverts all current from white light source 132. The following table provides the component values for the embodiment shown in FIG. 8.

TABLE 4

Component values for circuit shown in FIG. 8.

| LABEL | COMPONENT |
|---|---|
| VR1 | ZRC500 |
| R1 | 4.75K |
| R2 | 221K |
| R3 | 10K |
| R4 | 100K |
| R5 | 100K |
| R6 | 1.0 |
| R7 | 20 |
| D1 | Diode |
| D2-D4 | Zener Diode |
| D5 | TVS |
| OA1 | LMV342 |
| OA2 | LMV342 |
| C1 | 1 uF |
| C2 | 0.01 uF |
| LED1-LED12 | 2800K LED |
| LED10-LED13 | 2200K LED |
| T1 | FET |

In the circuits shown in FIGS. 5-8, color light source 134 should have a slightly lower bias voltage than white light source 132. This is to ensure that color light source 134 diverts all current from white light source 132 when color light source 134 is switched on.

It may be preferable to eliminate the need to ensure that the total bias voltage of one light source is less than that of the other. Doing so eliminates a significant design consideration and renders the circuit more versatile and easy to tune. Specifically, it allows a designer to pick whatever color light source 134 or white light source 132 is desired without consideration for the circuit properties of either. This allows the designer to easily tune the brightness and color curve of the lighting system to whatever specifications desired.

Figure 9:
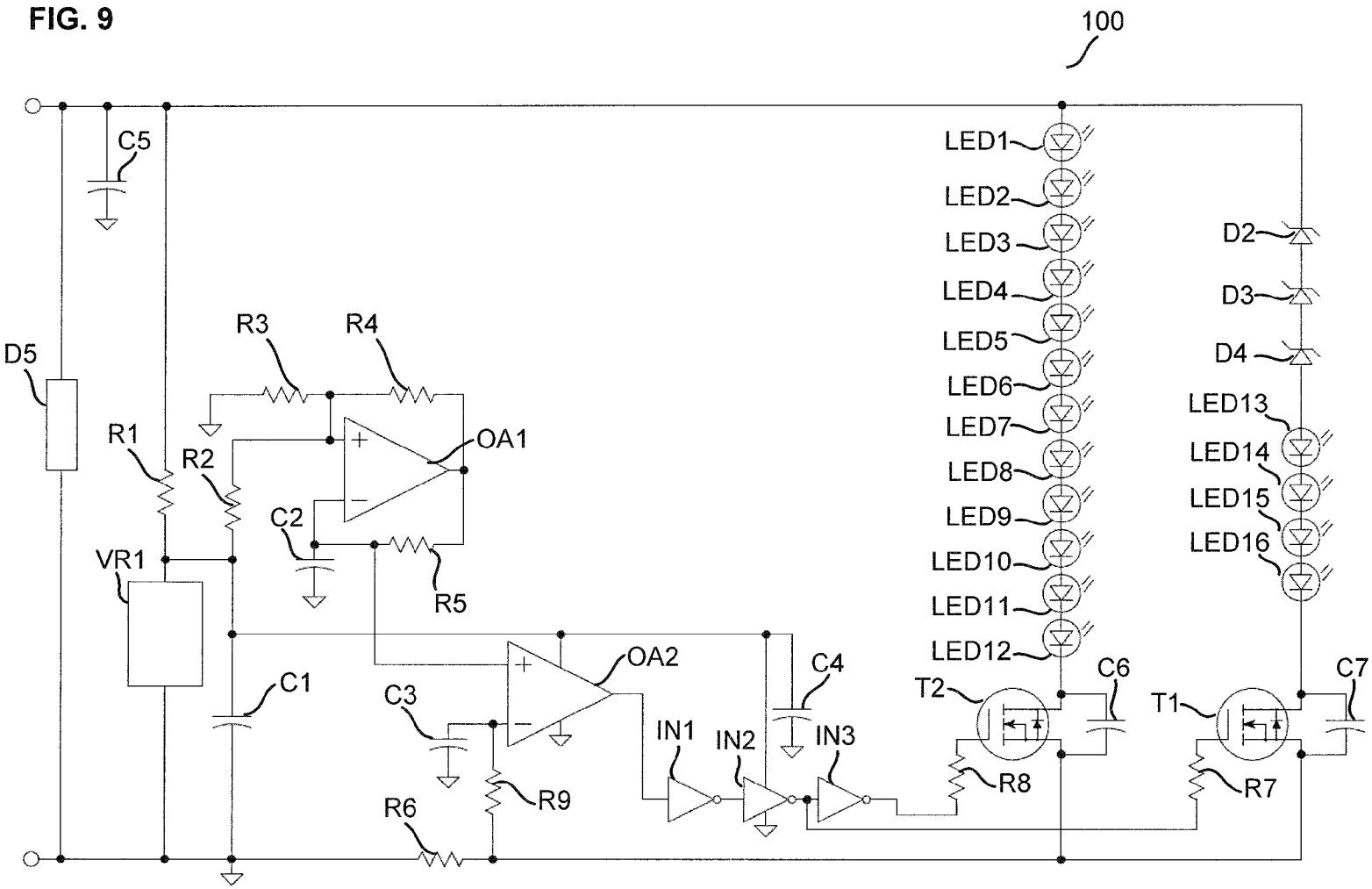
FIG. 9 is a schematic of a lighting system according to the embodiment shown in FIG. 1.

The circuit shown in FIG. 9 accomplishes the above objective. In this embodiment, the lighting system includes a second transistor switch T2 such that each of the white light source 132 and color light source 134 is controlled by a separate switch. Specifically, field-effect transistor T2 is connected in series with (or otherwise controls) white light source 132 (LED1-LED12), and transistor T1 is connected in series with (or otherwise controls) color light source (LED13-LED16). Both T1 and T2 are controlled by comparator OA2. Inverter buffer IN1-IN3 is a series of at least three inverters that allows only one comparator OA2 to operate both switches T1 and T2. The system is designed to operate such that T1 and T2 are on at opposite times. Therefore, IN1-IN3 are connected in series and T1 is connected to the output of IN2 and T2 is connected to the output of IN3. Since IN3 inverts the output of IN2, T1 and T2 will always have the opposite control signal and will be on at opposite times.

As shown, the color light source 134 may have substantially fewer LEDs than the white light source 132 (e.g., 4 LEDs in the color light source as compared to 12 LEDs in the white light source). Three Zener diodes D1-D3 in series with the color LEDs increase the total bias voltage of color light source 134 to approximate that of white light source 132 (the Zener diodes D1-D3 being considered to be part of color light source 134). This ensures that brightness and current levels of the two light sources are closely matched. However, color light source 134 may have a total bias voltage that is greater or lesser than that of white light source 132. For example, the circuit shown in FIG. 9 allows for color light source 134 to have a higher total bias voltage than white light source 132.

Inverters IN1-IN3 have the further advantage of buffering the comparator's output. This means that T1 and T2 will behave more like switches because the output at IN2 and IN3 will either be full voltage or ground, instead of a more gradual transition between those values as the comparator reverses its output.

In the circuit shown in FIGS. 9, C3 and R9 are connected to the negative input on OA2 to create a low-pass filter which eliminates flicker at that input (and by extension the switching circuit). C6 and C7 are connected across the source and drain terminals of FETs T1 and T2 to smooth the light output of color light source 134 and white light source 132 and prevent flicker. Capacitor C4 connects to the power source of OA2 to ground and C5 connects the current source to ground to stabilize the circuit and prevent feedback and flicker.

The following table provides the component values for the embodiment shown in FIG. 9.

TABLE 5

Component values for circuit shown in FIG. 9.

| LABEL | COMPONENT |
|---|---|
| VR1 | ZRC500 |
| R1 | 4.75K |
| R2 | 221K |
| R3 | 10K |
| R4 | 100K |
| R5 | 100K |
| R6 | 1.0 |
| R7 | 2.25K |

TABLE 5-continued

Component values for circuit shown in FIG. 9.

| LABEL | COMPONENT |
|---|---|
| R8 | 2.25K |
| R9 | 100K |
| D1 | Diode |
| D2-D4 | 6.2 V Zener Diode |
| D5 | TVS |
| OA1 | LMV342 |
| OA2 | LMV342 |
| C1 | 1 uF |
| C2 | 0.01 uF |
| C3 | 0.1 uF |
| C4 | 0.1 uF |
| C5 | 10 uF |
| C6 | 0.1 uF |
| C7 | 0.1 uF |
| LED1-LED12 | 2800K LED |
| LED10-LED13 | 2200K LED |
| T1-T2 | FET |
| IN1-IN3 | HC04 |

Figure 10:
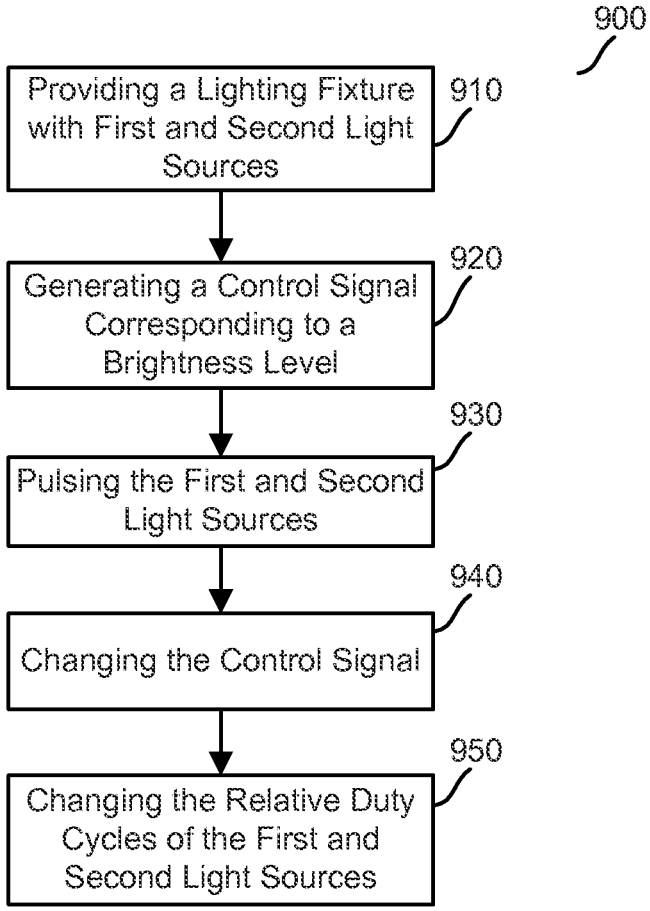
FIG. 10 is a method of controlling a lighting system employable by the embodiment shown in FIG. 1.

FIG. 10 is a diagram of a method 900 according to one embodiment. Method 900 includes the steps of providing a lighting fixture with first and second light sources 910 and generating a control signal corresponding to a brightness level 920. Method 900 further includes the steps of pulsing first and second light sources 930, changing the control signal 940, and changing the relative duty cycles of the first and second light sources 950. The first and second light sources can be white and color light sources, respectively.

A controller generates the control signal corresponding to a selected brightness level of the lighting fixture. The controller can be a dimmer and the control signal can be a current level. The first and second light sources are pulsed when the light fixture is within a range of brightness levels. The relative duty cycles of the light sources are changed, in response to a change in the control signal, to alter a perceived color output of the lighting fixture, as the brightness level of the lighting fixture is changed by the controller.

A comparator compares a reference voltage to a signal voltage, where the reference voltage relates to an aggregate current driving the first and second light sources and the signal voltage relates to a periodic signal generated by an oscillator. A switch controlled by the comparator is in series with one of the first and second light sources to pulse the light sources.

The signal voltage varies between a maximum value and a minimum value. The maximum value of the signal voltage exceeds the reference voltage when the brightness level of the lighting fixture is below a predetermined brightness level. When the brightness level of the lighting fixture is above the predetermined brightness level, the switch is held in a predetermined open or closed state. When the brightness level is below the predetermined brightness level, the comparator alternates the switch between open and closed states, when the reference voltage exceeds the minimum value of the signal voltage.

The first and second light sources can be alternately pulsed, whereby when the first light source is pulsed on, second light source is off and when second light source is pulsed on, first light source is off. The duty cycles of the first and second light sources can vary inversely.

Preferably, the light fixture has optical elements, such as a light mixing chamber, to blend the different colors of light from the LEDs. Preferably, the LEDs of the lighting fixture are grouped together in an LED cluster which is surrounded by a cone-shaped white reflector that is covered by a diffuser lens to properly direct, collimate and mix the light emanating from the individual LEDs to provide a blended color light output. The reflector is preferably comprised of 98% reflective material and the diffuser lens can be comprised of a plastic diffuser lens or another suitable type of diffuser.

The end result is an LED lighting system that mimics the color change exhibited by incandescent light when dimmed, closely following the BBL curve. In other words, the spectral output (or color temperature) of the light at each brightness level resembles the appropriate spectral curve for black matter at that thermal temperature (as in an incandescent bulb). Therefore, the spectral output or color temperature of the lighting system described herein is either directly on the BBL curve or substantially on it. It is desired that the light output be within the two-step McAdams ellipse, whereby the output is imperceptibly different from incandescent or BBL output. Furthermore, if all lights manufactured with this technology fit within the two-step McAdams ellipse, there will be no perceptible color differences between multiple LED lights, even as they are concurrently dimmed.

Testing of the color temperature and chromaticity of the lighting system disclosed herein has shown that the lighting system is on or substantially on the BBL curve. For example, a lighting fixture constructed according the light system disclosed herein has been found to exhibit the color temperature (Tc) and chromaticity coordinate values (CCx, CCy) set forth in Table 5 below at various dimmer settings ranging from 100% (fully on) to 10% (90% dimmed).

TABLE 6

Color Characteristics of the Lighting

| Current Level | CC*x* | CC*y* | Temperature |
|---|---|---|---|
| 100% (Full on) | 0.4432 | 0.4064 | 2916K |
| 75% | 0.4494 | 0.4080 | 2832K |
| 50% | 0.4579 | 0.4097 | 2721K |
| 10% (90% dimmed) | 0.4707 | 0.4105 | 2556K |

This system has the advantage of having integral control within the light engine because the circuitry can be contained within light engine printed circuit board (PCB) housing the LEDs, without the need for external control such as a remote control board. However, as can be appreciated, the control circuitry could be located remote from the LED light engine, if desired (for example in the driver circuitry or components). This system has further advantages because it is capable of being driven by a conventional (and previously-installed) LED lighting current source and can be controlled by conventional dimmers. It is relatively simple, elegant, and easily tunable. The lighting system is completely analog, therefore the warming of the color temperature as the light is dimmed is perfectly smooth and is without any discrete steps of jumps perceptible to human observers.

As disclosed above, the control signal corresponding to a selected brightness of the lighting fixture can be a current signal (i.e., a current level) regulated by a suitable controller, such as a dimmer. However, the control signal can be another electrical characteristic produced or regulated by a different type of electronic component or device. For example, the control signal could be signal based on voltage, resistance, or inductance, or another suitable electronic characteristic, produced or regulated by a suitable electronic component or device.

Although the invention has been described with reference to embodiments herein, those embodiments do not limit the scope of the invention. Modification to those embodiments or different embodiments may fall within the scope of the invention.

What is claimed is:

1. A lighting system, comprising:

a light having a white light source and a color light source;

a control circuit controlling said white and color light sources in response to a brightness control signal corresponding to a selected brightness level of said light;

said control circuit pulsing said white light source and said color light source when said light is within a range of brightness levels, and in response to a change in said brightness control signal, said control circuit changing duty cycles of said white and color light sources, to alter a perceived color output of said light;

a switch controlling one of said white light source and said color light source;

a signal generator producing a periodic signal;

a comparator receiving said periodic signal from said signal generator and controlling said switch;

said comparator comparing a reference voltage to a signal voltage, said reference voltage relating to an aggregate current driving said white and color light sources and said signal voltage relating to said periodic signal; and said switch being in one of an open state and a closed state when said reference voltage exceeds said signal voltage and being in an other of said open and closed states when said signal voltage exceeds said reference voltage.

2. The lighting system of claim 1, wherein:

said signal voltage varies between a maximum value and a minimum value; and said maximum value of said signal voltage exceeds said reference voltage when the brightness level of said light is below a predetermined brightness level;

whereby when the brightness level of said light is above said predetermined brightness level, said switch remains in said one of said open and closed states, and whereby, when the brightness level is below said predetermined brightness level, said switch alternates between said open and closed states when said reference voltage exceeds said minimum value of said signal voltage.

3. The lighting system of claim 1, further comprising:

said switch comprising a first switch controlling said color light source;

a second switch controlling said white light source; and an inverter receiving an output of said comparator;

wherein one of said first and second switches is controlled by a non-inverted output of said comparator and an other of said first and second switches is controlled by an inverted output of said comparator so that said first switch and said second switch are in opposite open or closed states.

4. The lighting system of claim 3, further comprising:

a series of at least three inverter buffers receiving the output of said comparator;

wherein said one of said first and second switches is controlled by an output of two inverter buffers in series and said other of said first and second switches is controlled by an output of three inverter buffers in series.

5. The lighting system of claim 1, wherein:

said white light source and said color light source comprise LEDs;

one light source of said white light source and said color light source has a high total bias voltage;

an other light source of said white light source and said color light source has a low total bias voltage, which is lower than the high total bias voltage of said one light source;

said switch controls said one light source having the low total bias voltage; and said other light source having the high total bias voltage is connected in parallel with said one light source having the low total bias voltage;

whereby when said switch is in said open state, said one light source having the low total bias voltage is off, and said other light source having the high total bias voltage is on, and, when said switch is in said closed state, said one light source having the low total bias voltage is turned on, and said other light source having the high total bias voltage is automatically turned off.

6. The lighting system of claim 5, wherein:

said color light source is said one light source having the low total bias voltage; and said switch is in said open state when said reference voltage exceeds said signal voltage, and is in said closed state when said signal voltage exceeds said reference voltage.

7. The lighting system of claim 1, wherein:

a duty cycle of said color light source varies inversely to a duty cycle of said white light source.

8. The lighting system of claim 7, wherein:

said control circuit pulses said white light source and said color light source alternately, whereby when said white light source is pulsed on, said color light source is off and when said color light source is pulsed on, said white light source is off.

9. The lighting system of claim 1, further comprising:

a current source providing a current;

said current drives said white and color light sources and said control circuit; and a dimmer connected to said current source.

10. The lighting system of claim 1, wherein said white light source comprises an LED producing light at or above 2800K, and said color light source comprises an LED producing light at or below 2200K.

11. The lighting system of claim 1, wherein said signal generator comprises a relaxation oscillator.

12. A lighting system, comprising:

a light having first and second light sources;

a control circuit controlling said first and second light sources in response to a brightness control signal corresponding to a selected brightness level of said light;

said control circuit alternately pulsing said first and second light sources when said light is within a range of brightness levels, whereby when said first light source is pulsed on, said second light source is off and when said second light source is pulsed on, said first light source is off;

said control circuit changing duty cycles of said first and second light sources, in response to a change in said brightness control signal; and wherein duty cycles of said first and second light sources vary in a predetermined manner with respect to an aggregate current driving said first and second light sources.

13. The lighting system of claim 12, further comprising:

a switch controlling one of said first and second light sources;

a signal generator producing a periodic signal;

a comparator receiving said periodic signal from said signal generator and controlling said switch;

said comparator comparing a reference voltage to a signal voltage, said reference voltage relating to an aggregate current driving said first and second light sources and said signal voltage relating to said periodic signal; and said switch being in one of an open state and a closed state when said reference voltage exceeds said signal voltage and being in an other of said open and closed states when said signal voltage exceeds said reference voltage.

14. The lighting system of claim 13, wherein:

said signal voltage varies between a maximum value and a minimum value; and said maximum value of said signal voltage exceeds said reference voltage when the brightness level of said light is below a predetermined brightness level;

whereby when the brightness level of said light is above said predetermined brightness level, said switch remains in said one of said open and closed states, and whereby, when the brightness level is below said predetermined brightness level, said switch alternates between said open and closed states when said reference voltage exceeds said minimum value of said signal voltage.

15. The lighting system of claim 13, further comprising:

said switch comprising a first switch controlling said first light source;

a second switch controlling said second light source; and an inverter receiving an output of said comparator;

wherein one of said first and second switches is controlled by a non-inverted output of said comparator and an other of said first and second switches is controlled by an inverted output of said comparator so that said first switch and said second switch are in opposite open or closed states.

16. The lighting system of claim 15, further comprising:

a series of at least three inverter buffers receiving the output of said comparator;

wherein said one of said first and second switches is controlled by an output of two inverter buffers in series and said other of said first and second switches is controlled by an output of three inverter buffers in series.

17. The lighting system of claim 13, wherein:

said first and second light sources comprise LEDs;

one light source of said first and second light sources has a high total bias voltage;

an other light source of said first and second light sources has a low total bias voltage, which is lower than the high total bias voltage of said one light source;

said switch controlling said one light source having the low total bias voltage; and said other light source having the high total bias voltage is connected in parallel with said one light source having the low total bias voltage;

whereby when said switch is in said open state, said one light source having the low total bias voltage is off, and said other light source having the high total bias voltage is on, and, when said switch is in said closed state, said one light source having the low total bias voltage is turned on, and said other light source having the high total bias voltage is automatically turned off.

18. The lighting system of claim 12, wherein:

a duty cycle of said first light source varies inversely to a duty cycle of said second light source.

19. The lighting system of claim 12, further comprising:

a current source providing a current;

said current drives said first and second light sources and said control circuit, and a dimmer connected to said current source.

20. A method of controlling a lighting system, comprising the steps of:

providing a light having a white light source and a color light source;

generating a control signal corresponding to a selected brightness level of said light; and pulsing said white light source and said color light source when said light is within a range of brightness levels, and in response to a change in the control signal, changing duty cycles of said white and color light sources, to alter a perceived color output of said light, as the brightness level of said light is changed by the control signal;

wherein duty cycles of said white light source and said color light source vary in a predetermined manner with respect to an aggregate current driving said white light source and said color light source.

21. The method of claim 20, further comprising:

providing a switch that controls one of said white light source and said color light source;

generating a periodic signal;

a comparator receiving said periodic signal and controlling said switch;

said comparator comparing a reference voltage to a signal voltage, said reference voltage relating to an aggregate current driving said white and color light sources and said signal voltage relating to said periodic signal; and said switch being in one of an open state and a closed state when said reference voltage exceeds said signal voltage and being in an other of said open and closed states when said signal voltage exceeds said reference voltage.

22. The method of claim 21, further comprising:

varying said signal voltage between a maximum value and a minimum value, where said maximum value of said signal voltage exceeds said reference voltage when the brightness level of said light is below a predetermined brightness level; and when the brightness level of said light is above said predetermined brightness level, holding said switch in said one of said open and closed states, and when the brightness level is below said predetermined brightness level, alternating said switch between said open and closed states when said reference voltage exceeds said minimum value of said signal voltage.

23. The lighting system of claim 21, further comprising:

said switch comprising a first switch controlling said color light source;

providing a second switch controlling said white light source; and providing an inverter receiving an output of said comparator;

wherein one of said first and second switches is controlled by a non-inverted output of said comparator and an other of said first and second switches is controlled by an inverted output of said comparator so that said first switch and said second switch are in opposite open or closed states.

24. The lighting system of claim 23, further comprising:

providing a series of at least three inverter buffers receiving the output of said comparator;

wherein said one of said first and second switches is controlled by an output of two inverter buffers in series and said other of said first and second switches is controlled by an output of three inverter buffers in series.

25. The method of claim 21, further comprising:

providing said white light source and said color light source with LEDs;

providing one light source of said white light source and said color light source with a high total bias voltage;

providing an other light source of said white light source and said color light source with a low total bias voltage, which is lower than the high total bias voltage of said one light source;

connecting said switch that controls said one light source having the low total bias voltage bias voltage; and said other light source having the high total bias voltage is connected in parallel with said one light source having the low total bias voltage;

whereby when said switch is in said open state, said one light source having the low total bias voltage is off, and said other light source having the high total bias voltage is on, and, when said switch is in said closed state, said one light source having the low total bias voltage is turned on, and said other light source having the high total bias voltage is automatically turned off.

26. The method of claim 20, further comprising:

varying a duty cycle of said color light source inversely to a duty cycle of said white light source.

27. The method of claim 26, further comprising:

pulsing said white light source and said color light source alternately, whereby when said white light source is pulsed on, said color light source is off and when said color light source is pulsed on, said color light source is off.

28. The method of claim 20, further comprising:

providing a current to drive said white and color light sources and said control circuit; and providing a dimmer connected to said current source.

29. A method of controlling a lighting system, comprising the steps of:

providing a light having first and second groups of LEDs, each group having at least one LED;

providing a variable current to drive the first and second groups of LEDs; and alternately pulsing the first and second groups of LEDs;

wherein duty cycles of the first and second groups of LEDs vary in a predetermined manner with respect to an aggregate current driving the first and second groups of LEDs.

30. The method of claim 29, wherein:

the duty cycle of the first group of LEDs varies inversely to the duty cycle of the second group of LEDs.

31. The method of claim 30, wherein:

the first and second groups of LEDs have on and off states; and when the first group of LEDs is in one of the on and off states, the second group of LEDs is in an opposite one of the on and off states.

* * * * *